US012134451B2

(12) United States Patent
Phamdo et al.

(10) Patent No.: US 12,134,451 B2
(45) Date of Patent: Nov. 5, 2024

(54) ELECTRIC-POWERED BOAT OR MARINE VESSEL

(71) Applicant: Voltaic LLC, Beaverton, OR (US)

(72) Inventors: Richard Phamdo, Beaverton, OR (US); Paul Lackey, Hillsboro, OR (US); Robert D Simpson, Banks, OR (US); Wariz Abdul, Kerala (IN)

(73) Assignee: Voltaic LLC, Beaverton, OR (US)

( * ) Notice: Subject to any disclaimer, the term of this patent is extended or adjusted under 35 U.S.C. 154(b) by 403 days.

(21) Appl. No.: 17/576,013

(22) Filed: Jan. 14, 2022

(65) Prior Publication Data

US 2023/0227139 A1 Jul. 20, 2023

(51) Int. Cl.
*B63H 21/17* (2006.01)
*B63H 21/30* (2006.01)

(52) U.S. Cl.
CPC ..... *B63H 21/17* (2013.01); *B63H 21/305* (2013.01)

(58) Field of Classification Search
CPC ..... B63H 21/17; B63H 21/305
See application file for complete search history.

(56) References Cited

U.S. PATENT DOCUMENTS 2,612,130 A 9/1952 Wendt
4,406,630 A * 9/1983 Wood, Jr. ..... B63H 5/125 114/57
D680,053 S 4/2013 Ulgen
D691,546 S 10/2013 Yamamoto
D818,419 S 5/2018 Mattila
D894,090 S 8/2020 Gray et al.
D983,117 S 4/2023 Kamsvåg
2015/0027125 A1 1/2015 Raj
2015/0060170 A1* 3/2015 Templeman ..... H01M 50/267 180/68.5
2017/0015397 A1 1/2017 McGrath et al.
(Continued)

FOREIGN PATENT DOCUMENTS

CN 106275343 A 1/2017
CN 113173238 A 7/2021
DE 102018101213 A1 7/2019
(Continued)

OTHER PUBLICATIONS

Notification of Transmittal of the International Search Report and the Written Opinion of the International Searching Authority, or the Declaration, App. No. PCT/US2023/060581, Mailed May 12, 2023, 101 pages.

(Continued)

*Primary Examiner* — Stephen P Avila
(74) *Attorney, Agent, or Firm* — COOLEY LLP

(57) ABSTRACT

A marine vessel includes a hull assembly, and the hull assembly includes a deck assembly, a first battery assembly, a second battery assembly and an electric motor assembly. The deck assembly is contained within the hull assembly. The first battery assembly is located completely under the deck assembly. The second battery assembly is located completely under the deck assembly and is physically separate from the first battery assembly. The electric motor assembly receives electric power from the first battery assembly and the second battery assembly to propel the hull assembly through water during operation.

19 Claims, 7 Drawing Sheets

(56) References Cited

U.S. PATENT DOCUMENTS

2023/0059445 A1 2/2023 Lammers-Meis et al.

FOREIGN PATENT DOCUMENTS

| | | | | |
|---|---|---|---|---|
| JP | WO2011061963 A1 | | 4/2013 | |
| WO | WO-2011061963 A1 | * | 5/2011 | ..... B63H 20/00 |
| WO | WO-2023137394 A1 | | 7/2023 | |

OTHER PUBLICATIONS

The Maritime Executive, "World's First All-Electric Tugboat Delivered, Three More on the Way," Navtek Naval Technologies, https://maritime-executive.com/author/navtek-naval-technologies, Aug. 4, 2020, 7 pages.

Anonymous, "World's First All-Electric Tugboat Delivered, Three More Under Construction," Aug. 26, 2020, https://www.zeetug.com/postworld-s-first-all-electric-tug-delivered-and-three-more-under-construction, 3 pages.

Notice of Allowance for U.S. Appl. No. 29/823,252, dated Apr. 10, 2024, 5 pages.

Office Action for CA Application No. 214269, dated Jan. 4, 2024, 2 pages.

Office Action for CN Application No. 202230447806.0, dated Jul. 5, 2023, 3 pages.

Office Action for TW Application No. 112101211, dated Jan. 12, 2024, 12 pages.

Office Action for U.S. Appl. No. 29/823,252, dated Jul. 31, 2023, 12 pages.

Office Action Response for CN Application No. 202230447806.0, dated Nov. 20, 2023, 24 pages.

Voltaic Marine "AEW24" voltaicmarine.com, Published: Unavailable. Retrieved on Jul. 10, 2023, Jul. 10, 2023. Available online URL: https://voltaicmarine.com/, 2 pages.

Yamaha Boats "195 FSH Sport Center Console Boats" yamahaboats.com, Published: Unavailable. Retrieved on Jul. 10, 2023. Retrieved online URL: https://www.yamahaboats.com/boats/categories/center-console-boats/195FSHSport/, 5 pages.

* cited by examiner

ELECTRIC-POWERED BOAT OR MARINE VESSEL

BACKGROUND

1. Field

The present disclosure relates generally to boat or marine vessels and, more particularly, an electric-powered boat or marine vessel hull, which includes an improved battery and battery module design.

2. Information

Electric-powered recreational boats or marine vessels currently have limited ability to provide the necessary power for wake boarding and/or wake surfing if the recreational boats or marine vessels are less than 27 feet long. These electric-powered recreational boats or marine vessels also lack user space on the deck, as well as storage space below the deck. Accordingly, a need exists for an electric-powered recreational boat or marine vessel less than 27 feet in length that is able to provide power capable of supporting wake boarding and/or wake surfing.

In the following detailed description, numerous specific details are set forth to provide a thorough understanding of claimed subject matter. However, it will be understood by those skilled in the art that claimed subject matter may be practiced without these specific details. In other instances, methods, assemblies, and/or components thereof that would be known by one of ordinary skill have not been described in detail so as not to obscure claimed subject matter.

BRIEF DESCRIPTION OF THE DRAWINGS

Non-limiting and non-exhaustive aspects are described with reference to the following figures, wherein like reference numerals refer to like parts throughout the various figures unless otherwise specified.

DETAILED DESCRIPTION

Some example implementations relating to an improved or enhanced boat or marine vessel are described herein. In this context, the terms "marine vessel," or "boat" may be used interchangeably. The terms "battery assembly" or "battery pack" may also be utilized interchangeably.

Figure 1:
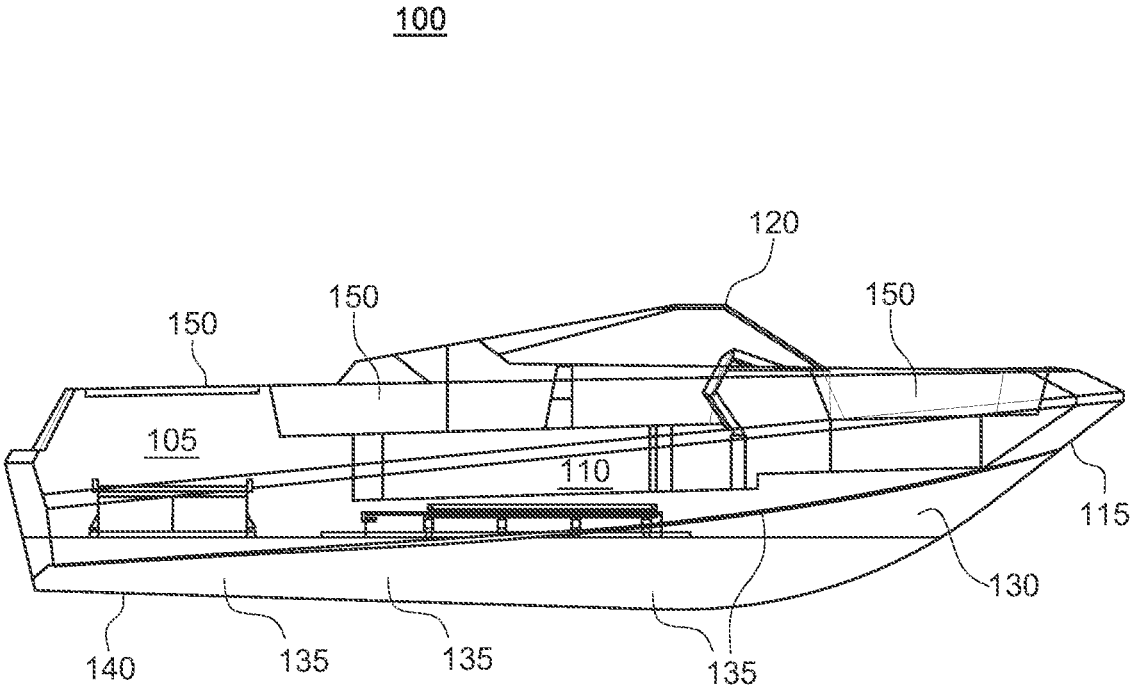
FIG. 1 illustrates a side perspective view of an enhanced electric-powered marine vessel according to some implementations.
Figure 2:
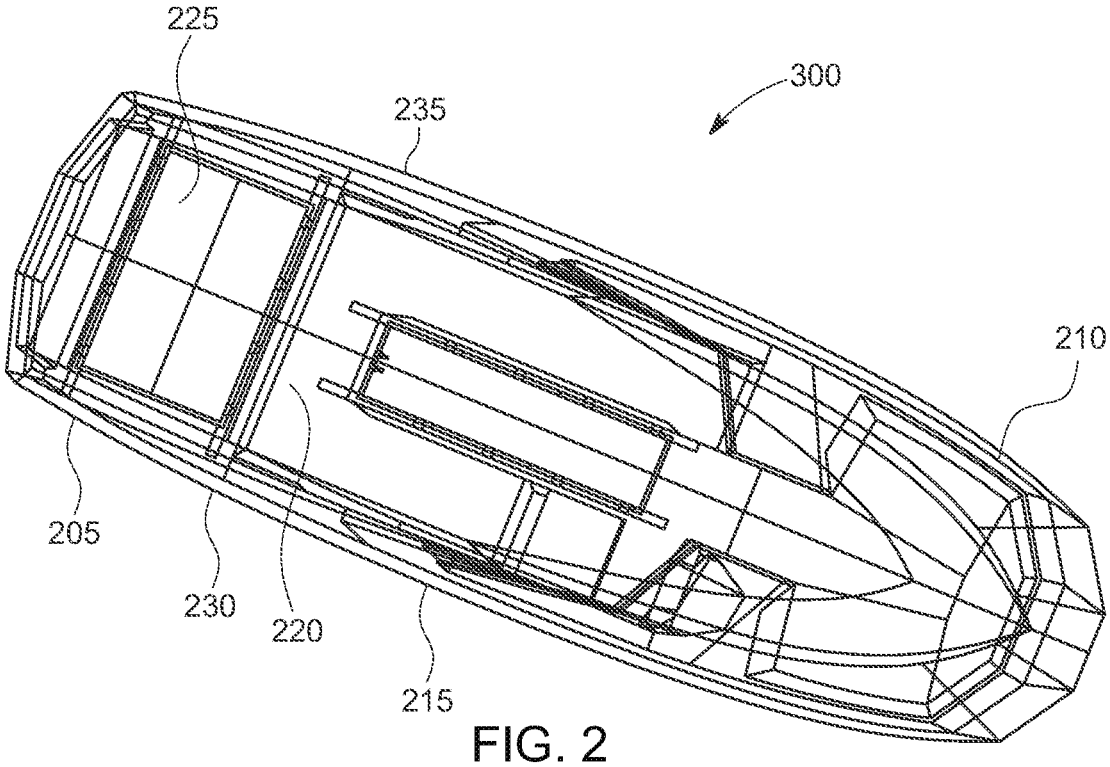
FIG. 2 illustrates a top view of the hull assembly of a marine vessel according to some implementations.

Referring now to FIGS. 1 and 2, which are illustrations of an implementation of an electric-powered recreational boat or marine vessel 100. It should be noted that like numerals may designate like parts throughout to indicate corresponding and/or analogous components. It will also be appreciated that components illustrated have not necessarily been drawn to scale, such as for simplicity and/or clarity of illustration. For example, dimensions of some components may be exaggerated relative to other components. Further, it is to be understood that other embodiments implementations may be utilized. Furthermore, structural and/or other changes may be made without departing from the scope and spirit of claimed subject matter. It should also be noted that directions and/or references, such as, for example, up, down, top, bottom, and so on, if applicable or appropriate, may be used to facilitate or support discussion and are not intended to restrict application of claimed subject matter. Therefore, the following detailed description is not to be taken to limit claimed subject matter and/or equivalents.

FIG. 1 illustrates a side perspective view of an enhanced electric-powered recreational vehicle according to some implementations. As illustrated in FIG. 1, according to an implementation, electric-powered recreational boat or marine vessel 100 may include a hull assembly 115, a rudder 140 and a windshield 120. In an implementation, for example, hull assembly 115 may include one or more ballast assemblies 135, a bilge area 130, a deck surface 150, an electric-powered motor assembly (not shown), a gear box (not shown), a propellor assembly, a first battery pack or assembly 105, and/or a second battery pack or assembly 110. In an implementation, for example, the first battery pack or assembly 105 and/or the second battery pack or assembly 110 may provide electric power to an-electric-powered motor assembly. In an implementation, for example, the electric-powered motor assembly may apply a torque to a gear box to a shaft to rotate a propellor assembly which propels hull assembly 115 (and thus electric-powered boat or marine vessel 100) through water (e.g., a lake, an ocean and/or a river). In an implementation, for example, rudder 140 and/or a steering wheel or steering assembly (not shown) may be utilized in steering electric-powered boat or marine vessel 100 in specific directions. In an implementation, a throttle assembly (not shown) may control a speed at which electric-powered boat or marine vessel 100 is to move. In an implementation, windshield 120 may protect a boat or marine vessel driver and/or other passengers from water spray or air flow while electric-powered boat or marine vessel 100 is moving. In an implementation, for example, bilge area 130 of hull assembly 115 may comprise a bottom portion of an inside of hull assembly 115, which may collect water that has entered the marine vessel 100. In some embodiments, electric-powered boat or marine vessel 100 may comprise one or more ballast assemblies 135. For example, one or more ballast assemblies 135 may provide ballast or weight to hull assembly 115. One or more ballast assemblies 135 may be located underneath deck surface 150 of hull assembly 115. In an implementation, for example, electric-powered boar or marine vessel 100 may include hull assembly 115, first battery pack or assembly 105, second battery pack or assembly 110 and an electric-powered motor assembly (not shown).

In an implementation, first battery pack or assembly 105 and second battery pack or assembly 110 may be coupled and/or connected to the electric motor assembly in order to provide power to electric motor assembly. In an implementation, first battery pack or assembly 105 may be disposed below a deck surface or deck assembly 150 and not occupy any deck surface space. In an implementation, second battery pack or assembly 110 may also be disposed below deck surface or deck assembly 150 and also not occupy any deck space. In an implementation, for example, first battery pack or assembly 105 and second battery pack or assembly 110 may be physically separated and located in different areas of hull assembly 115, as illustrated in FIG. 1. Having first battery pack or assembly 105 and second battery pack or assembly 110 disposed below deck surface or desk assembly 150 may advantageously allow more space for boat users to utilize the electric-powered boat or marine vessel 100. In a particular implementation in which a gasoline-powered motor assembly of an existing boat or marine vessel design is replaced with an electric-powered motor assembly, an associated battery pack or assembly may be disposed in locations previously designated for gasoline tanks or internal combustion engines. As such, such an associated battery pack or assembly incorporated in such a design may be disposed above deck and/or in storage area since there is limited space available for battery packs below deck.

FIG. 2 illustrates a top view of a hull assembly of an electric-powered boat or marine vessel according to some implementations. In an implementation, hull assembly 115 may include a first battery pack or assembly 225, a second battery pack or assembly 220, a starboard side 230 and a port side 235. In an implementation, for example, hull assembly 115 may include a hull bow 210, a hull midship 215 and/or a hull stern 205. In an implementation, for example, as illustrated in FIG. 2, first battery pack or assembly 225 may be located in hull stern 205 of the hull assembly 115. In this implementation, for example, first battery pack or assembly 225 may be disposed and/or positioned equidistant from starboard side 230 and port side 235 in hull stern 205 of hull assembly 115. In some implementations, first battery pack or assembly 225 may be disposed in hull stern 205 and may distribute weight in hull stern 205 of the electric-powered boat or marine vessel between port side 235 and starboard side 230. In some implementations, a location and weight distribution of first battery pack or assembly 225 may increase boat or marine vessel stability at a variety of different speeds.

In particular implementations, positioning of first battery pack or assembly 225 in a hull stern 205 equidistant from starboard side 230 and port side 235 (or in a middle) provides stability to an electric-powered boat or marine vessel during low-speed operations. In some implementations, low speed operations occur at speeds 0 to 15 knots. In some implementations, a location and weight distribution of first battery assembly 225 in hull stern 205 may increase an electric-powered boat or marine vessel's ability to create and/or shape wakes for recreational sports. In some implementations, first battery assembly 225 may be positioned and/or disposed in hull stern 205. As illustrated in FIG. 2, hull stern 205 may be located behind passenger seating in hull midship 215 and/or behind passenger seating in hull bow 210. In some implementations, first battery pack or assembly 225 may be disposed below a sun deck level (which may be a deck surface in hull stern 205 of the boat or marine vessel). In some implementations, first battery pack or assembly 225 may be disposed under the sun deck surface and under a storage compartment (not shown), where such storage compartment may be disposed within the hull stern 205 of the electrically-powered boat or marine vessel. In other words, such a storage compartment may be located between a sun deck assembly and first battery pack or assembly 225.

In some implementations, second battery pack or assembly 220 may be disposed mid-hull 215 and/or may extend underneath a middle walkway in electric-powered boat or marine vessel 200. In some implementations, for example, second battery pack or assembly 220 may be located equidistant between hull bow 210 and hull stern 205 of electric-powered boat or marine vessel 200. In some implementations, second battery pack or assembly 220 may be disposed equidistant between starboard side 230 and port side 235 of electric-powered boat or marine vessel 200. Positioning and/or location of second battery pack or assembly 220 may enable balance and/or stability for electric-powered boat or marine vessel 200. In addition, positioning and/or location of second battery pack or assembly 220 may provide balance and/or stability for electric-powered boat or marine vessel during high-speed operations (e.g., 10 knots or more). In some implementations, second battery assembly 220 may be positioned or disposed in a space in the hull midship 215 that is in a middle of passenger seating and/or also below a deck level or deck surface. In some implementations, positioning and location of second battery pack or assembly 220 may distribute weight from a midship area 215 to hull bow 210 and a hull stern 205. In some implementations, positioning and/or location of second battery pack or assembly 220 may add to marine vessel stability from hull bow 210 to hull stern 205. In some implementations, positioning and/or location of second battery pack or assembly 220 may also add to electric-powered boat or marine vessel's ability to shape wakes for recreation sports, for example.

In the particular implementation of FIG. 2, hull assembly has no permanent structural parts or portions located above either first battery pack or assembly 225 and/or second battery pack or assembly 220. In other words, in some implementations, there may not be any immovable obstructions and/or major structural elements between deck surface and first battery pack or assembly 225 and/or second battery pack or assembly 220. This design allows first battery pack or assembly 225 and second battery pack or assembly 220 to be easily removed by removing deck surface and/or deck assembly 150. In existing boats or marine vessels, in order to replace battery assemblies or packs, a boat repair professional may have to cut or disassemble a hull assembly in order to access and/or remove such battery assemblies or packs. This is because battery assemblies or packs and/or electric motors may not be originally designed into a structure of an existing hull assembly (because the prior boats were gasoline-powered boats). Other implementations may place packs above deck or in place of gasoline engines and/or gasoline tanks so that they can be removed, reducing user space equating to lost storage area, user space and/or size of packs resulting is smaller packs and/or less battery energy capacity. Accordingly, location and/or accessibility of first battery pack or assembly 105 and second battery pack or assembly 110 is a significant advantage over existing boats or marine vessels.

In some implementations, first battery pack or assembly 105 may have a longer dimension extending from port side 235 to starboard side 230 than a dimension extending from hull stern 205 to hull bow 210. In some implementations, first battery pack or assembly 105 may have a dimension extending from port side 235 to starboard side 230 of approximately 1650 millimeters, a dimension extending from hull stern 205 to hull bow 210 of approximately 1072 millimeters, and/or a depth of approximately 270 millimeters. In some implementations, first battery pack or assembly 105 may have a dimension extending from port side 235 to starboard side 230 ranging from 1400 to 1800 millimeters, a dimension extending from hull stern 205 to hull bow ranging from 800 to 1200 millimeters and/or a depth ranging from 200 to 300 millimeters. Alternatively, in some implementations, first battery pack or assembly 105 may have a dimension extending from port side 235 to starboard side 230 ranging from 550 to 1800 millimeters, a dimension extending from hull stern 205 to hull bow ranging from 350 to 1200 millimeters and/or a depth ranging from 90 to 300 millimeters. In some implementations, first battery pack or assembly 105 may have a weight of 1950 pounds (lbs.). In some implementations, first battery pack assembly 105 may have a weight ranging from 1700 lbs. to 2100 pounds. Alternatively, in some implementations, first battery pack assembly 105 may have a weight ranging from 650 lbs. to 2100 pounds.

In some implementations, second battery pack or assembly 110 may have a dimension extending from hull stern 205 to hull bow 210 of approximately 2532 millimeters, a dimension extending from port side 235 to starboard side 230 of approximately 555 millimeters and a depth of approximately 160 millimeters. In some implementations, second battery pack or assembly 110 may have a dimension extending from hull stern 205 to hull bow 210 ranging from 2200 millimeters to 2800 millimeters, a dimension extending from port side 235 to starboard side 230 ranging from 400 millimeters to 750 millimeters and a depth of ranging from 140 to 180 millimeters. Alternatively, in some implementations, second battery pack or assembly 110 may have a dimension extending from hull stern 205 to hull bow 210 ranging from 844 millimeters to 2800 millimeters, a dimension extending from port side 235 to starboard side 230 ranging from 185 millimeters to 750 millimeters and a depth of ranging from 50 to 180 millimeters. In some implementations, second battery pack or assembly 110 may weigh approximately 650 pounds. In some implementations, second battery pack or assembly 110 may weigh between 500 pounds to 750 pounds. Alternatively, in some implementations, second battery pack or assembly 110 may weigh between 215 pounds to 750 pounds. In some implementations, first battery pack or assembly 105 and second battery pack or assembly 110 may be smaller in size and footprint as compared to previous battery assemblies.

In some implementations, first battery pack or assembly 105 and second battery pack or assembly 110 may provide a higher energy density than other implementations of battery assemblies for electrically-powered boats or marine vessels. Such increased energy density may allow first battery pack or assembly 105 and second battery pack or assembly 110 to provide power for recreational boat activities such as wake sports including wake boarding or wake surfing, for example. Such increased energy density may allow electric-power boats or marine vessels in some implementations to outperform prior boats or marine vessels in range traveled and/or run time (which may be referred to as duty cycle). In some implementations, an electric-powered boat or marine vessel may be less than 27 feet in length, although smaller length boats or marine vessels may also be created.

In some implementations, first battery pack or assembly 105 may generate a power output of approximately 150 kilowatt-hour. In some implementations, first battery pack assembly 105 may generate a power output ranging from 140 kilowatt-hour to 180 kilowatt-hour. Alternatively, in some implementations, first battery pack assembly 105 may generate a power output ranging from 140 kilowatt hour to 450 kilowatt hour. In some implementations, second battery pack or assembly 110 may generate a power output of approximately 50 kilowatt hour. In some implementations, second battery pack or assembly 110 may have a power output ranging from 40 to 80 kilowatt-hour. Alternatively, on some implementations, second battery pack or assembly 110 may have a power output ranging from 40 to 150 kilowatt-hour.

In some implementations, electric-powered boat or marine vessel run time goals for present are provided below for certain configurations, however the table described below should not be limiting in any way.

Marine Vessel Run Time Goals

| Boat Speed [Knots] | Power [Kilowatts] | Time [Hours] |
|---|---|---|
| 6 | 7.6 | 0.75 |
| 11 | 38.6 | 2 |
| 25 | 133 | 0.5 |

In order to achieve the identified run time goals, an electric-powered boat or marine vessel may consume approximately 200 kilowatt-hour of battery capacity or power. In these implementations, first battery pack or assembly 105 and second battery pack or assembly 110 may be designed to meet these energy or power goals and also to able to adhere to or meet space or physical objectives of the hull design. In some implementations run time goals may improve by a factor of 3 compared to previous run time goals.

In some implementations, an electric-powered boat or marine vessel may attempt to meet the above-identified power goals and adhere to space or physical objectives by combining a hull design, a battery pack or module design and/or a high voltage system (which includes an electric-powered motor assembly). In some implementations, an electric-powered boat or marine vessel may consume a defined kilowatt of continuous power. In some implementations, an electric-powered boat or marine vessel may achieve a defined kilowatt peak power for a defined amount of time. In some implementations, an electric-powered boat or marine vessel may achieve a peak capacity of 200 kilowatt hours or more.

In some implementations, first battery pack or assembly 105 and/or second battery pack or assembly 110 may generate power that is approximately 7.5 kilowatt hour per foot of hull and/or marine vessel length. In some implementations, first battery pack or assembly 105 and/or second battery pack or assembly 110 may generate power ranging from approximately 7 kilowatt hour to 22.5 kilowatt hour per foot of a hull or marine vessel length. In some implementations, an electric-powered boat or marine vessel may significantly increase energy density. This may allow smaller electric-powered boats or marine vessels to be utilized in recreational sports.

Due to the high-power output of first battery pack or assembly 105 and/or second battery pack or assembly 110, an electric-powered boat or marine vessel may have an available power density of approximately 165 Watt hour per kilogram. In some implementations, an electric-powered boat or marine vessel incorporating first battery pack or assembly 105 and/or second battery pack or assembly 110 may have an available power density ranging from 155 Watt hours per kilogram to 185 Watt hours per kilogram. Alternatively, in some implementations, an electric-powered boat or marine vessel incorporating first battery pack or assembly 105 and/or second battery pack or assembly 110 may have an available power density ranging from 155 Watt hours per kilogram to 495 Watt hours per kilogram. This may also allow smaller electric-powered boats or marine vessels to be utilized in recreational sports.

In some implementations, first battery pack or assembly 105 and/or second battery pack or assembly 110 may be disposed above one or more ballast areas 135 in hull assembly 115. In some implementations, first battery pack or assembly 105 and/or second battery pack or assembly 110 may be disposed above a majority of ballast areas or assemblies 135, which allows for maximum battery and ballast capacity of such an implementation of an electric boat. In some implementations, first battery pack or assembly and/or second battery pack or assembly may be located in bilge area 130.

Figure 3:
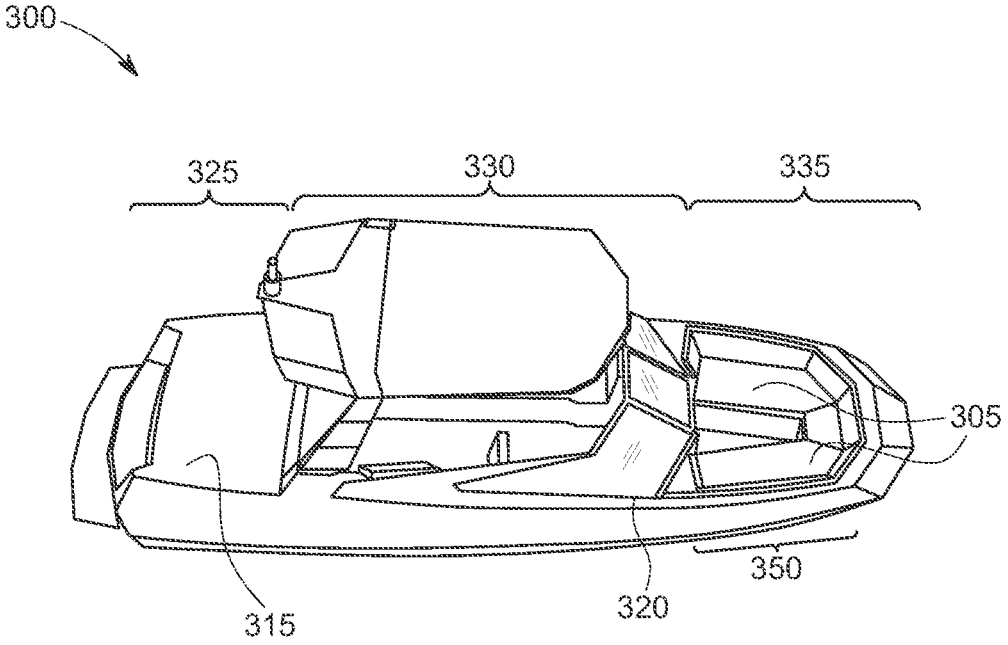
FIG. 3 illustrates a side view of a marine vessel according to some implementations.

FIG. 3 illustrates a side view of an electric-powered boat or marine vessel according to some implementations and comprises a hull bow or front area 335 (or bow portion assembly), a middle section 330 (or mid hull or midship), and a hull stern or back area 325 (stern portion assembly). In some implementations, hull bow or front area 335 has an open bow area 350 and wrap around seating 305. In some implementations, an open bow area 350 and/or open wrap around seating 305 are features that consumers desire in recreational boats or marine vessels. Space savings from disposing first battery pack or assembly 105 in hull stern area 325 and second battery pack or assembly 110 in mid-hull assembly 330 may permit inclusion of open bow area 350 and/or wrap around seating 305. In some implementations, hull stern or back area 325 may include a sun deck area 315. Space savings from disposing first battery pack or assembly 105 under and/or below sun deck area 325, may enable a larger amount of space for sun deck area 325, which is a feature consumers desire. In some implementations, hull stern or back area 325 may have a dimension of 6 feet measuring from a back of the hull stern to the hull bow. In some implementations, hull stern or back area 325 may have a dimension ranging from 5 feet to 7 feet measuring from a back of hull stern 325 to hull bow 335. In some implementations, the mid-hull, midship or middle section 330 may have a dimension of 13 feet measuring from a hull stern 325 to a hull bow 335. Alternatively, mid-hull, mid-hip or middle section 330 may have a dimension ranging from 11 feet to 15 feet measuring from hull stern to hull bow 335. In some implementations, hull bow or front area 335 may have a dimension of 6 feet measuring from a front of hull bow 335 towards hull stern 325. In some implementations, hull bow or front area 335 may have a dimension ranging from 5 feet to 7 feet measuring from a front of hull bow 335 to hull stern 325.

Figure 4A:
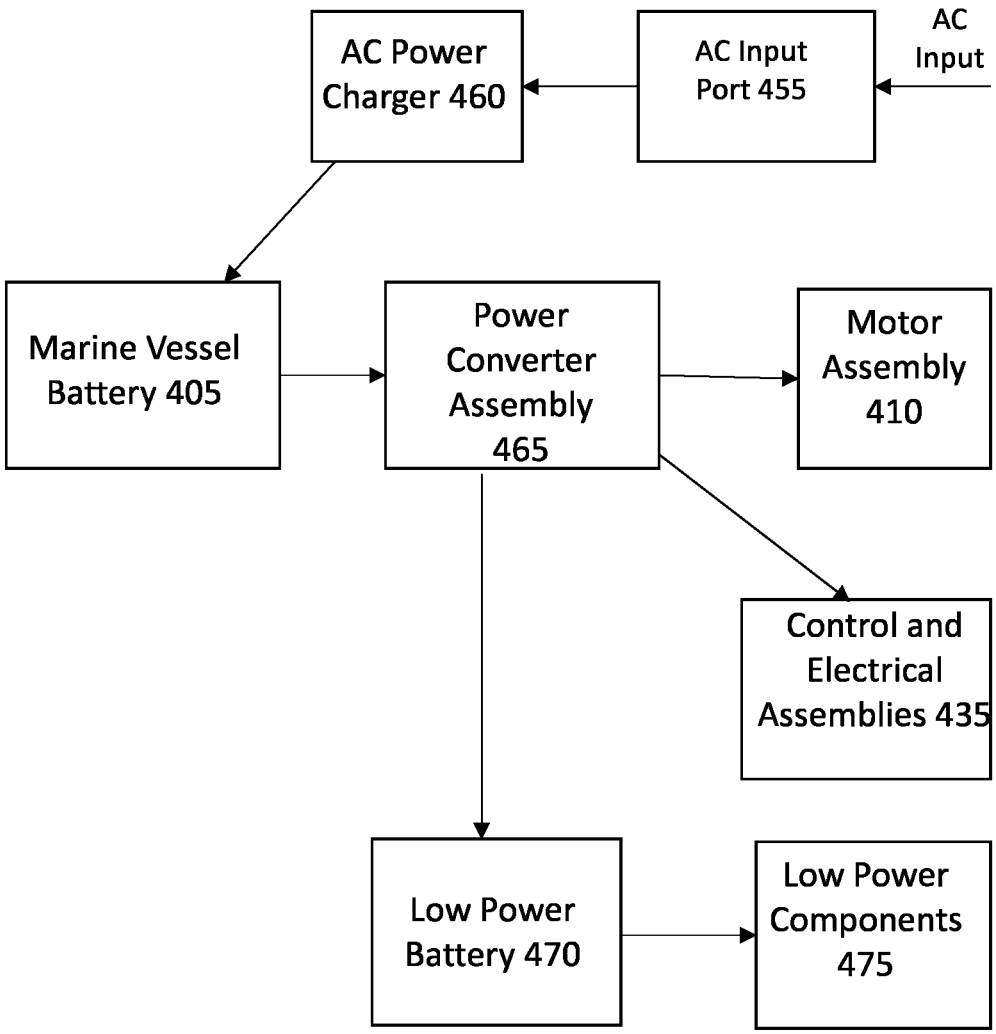
FIGS. 4A and 4B are schematic block diagram of electrical components in an electric-powered boat or marine vessel according to some embodiments.
Figure 4B:
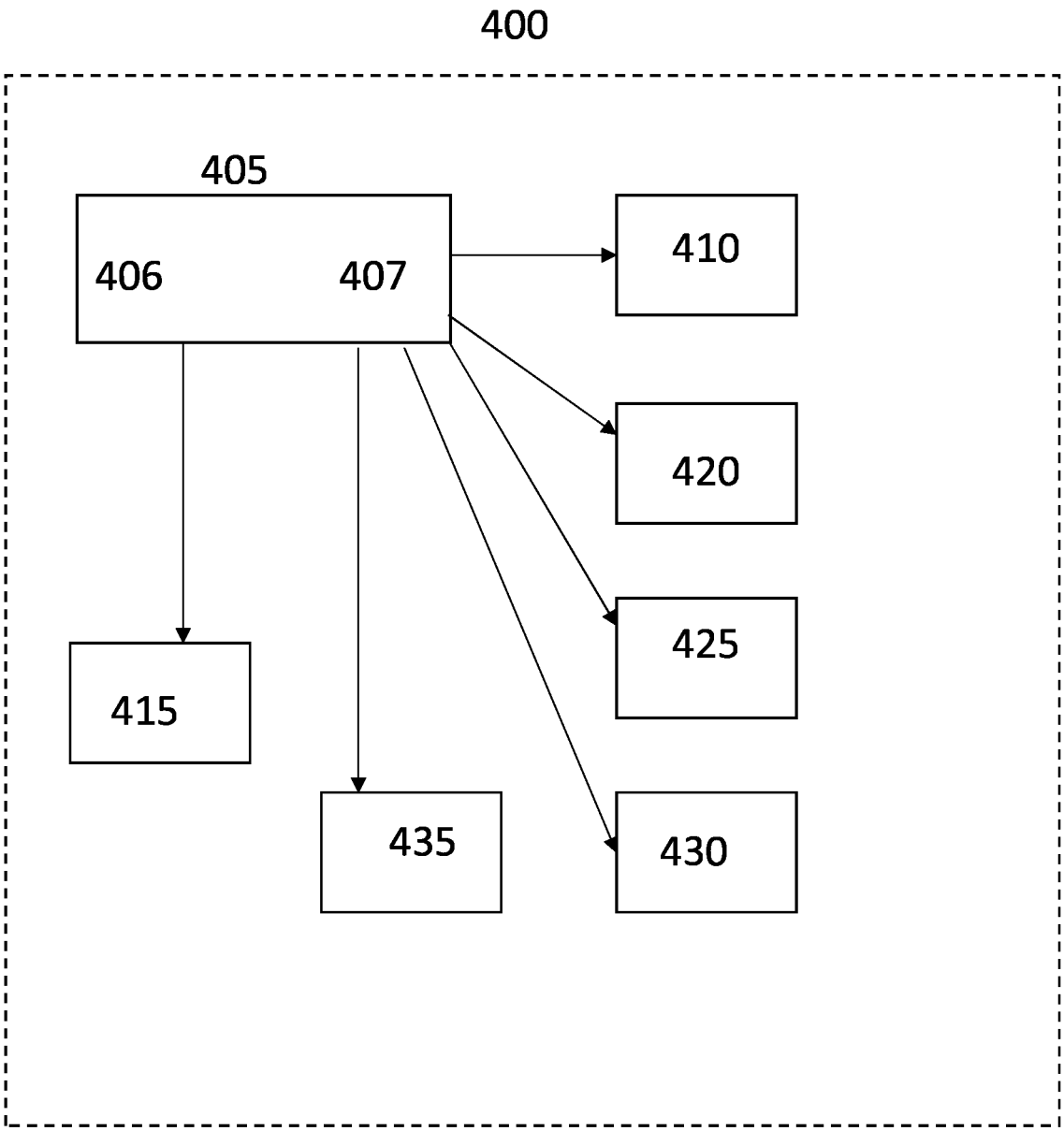

FIGS. 4A and 4B are schematic block diagram of electrical components in an electric-powered boat or marine vessel according to some embodiments. In some implementations, external alternating current (AC) power may be provided to an AC input port 455 of the electric-powered boat or marine vessel. In some implementations, the AC input power may be provided to the AC power charger 460. In some implementations, the AC power charger 460 may covert the AC power to high voltage power. In some implementations, the high voltage power may be provided to the battery system 405. In some implementations, electric-powered boat or marine vessel 400 may include a battery system 405, an electric motor assembly 410, a battery management system 415, one or more memory devices 420, battery management software 425, and/or one of more processors 430. In some implementations, battery system 405 may include a first battery pack or assembly 406 and/or a second battery pack or assembly 407. In some implementations, battery system 405 may provide power to electric motor assembly 410, battery management system 415, one or more memory devices 420, one or more processors 430, and vehicle control system or other electrical assemblies 435. In some implementations, the power converter assembly 465 may convert high voltage DC power to high voltage AC power to be supplied to the electric motor assembly 410. In some implementations, vehicle control system 435 may control operation of an electric-powered boat or marine vessel. In some implementations, the power converter assembly 465 may supply power and/or control signals to the vehicle control system and/or electrical assemblies 435. In some implementations, the power converter assembly 465 may convert the high voltage DC power to low voltage DC power and supply the low voltage DC power to the low power battery 420. In some implementations, the low power battery 420 may supply the low voltage DC power to the low power components 475 in the electric-powered marine vessel or boat. In some implementations, battery management software 425 may be stored in the one or more memory devices 420, may be accessed or loaded from one or more memory devices 420, and may be executed by one or more processors 420 to control and/or assist in controlling battery management system 415. In some implementations, battery management software 425 may monitor status and operational characteristics of the battery system 405. In some implementations, the battery management software 425 may receive battery measurements from one or more battery capacity sensors for first battery pack or assembly 406 and/or second battery pack or assembly 407. In some implementations, battery management software 425 may receive battery maintenance measurements or parameters from battery operation or maintenance sensors which identify whether there are any faults or maintenance issues for first battery pack or assembly 406 and/or second battery pack or assembly 407. In some implementations, battery management software 425 may receive heat measurements from heat sensors coupled to first battery pack or assembly 406 and/or second battery pack or assembly 407 in order to monitor heat within the battery system 405. In some implementations, battery management system 415 may include one or more supervisory printed circuit boards or supervisory chipsets and/or one or more slave printed circuit boards or slave chipsets. In some implementations, battery management system 415 and/or battery management software 425 may interface with vehicle control system or other electrical assemblies 435 to provide safe operation of the marine vessel by providing safe operational power to components of the marine vessel.

Figure 5:
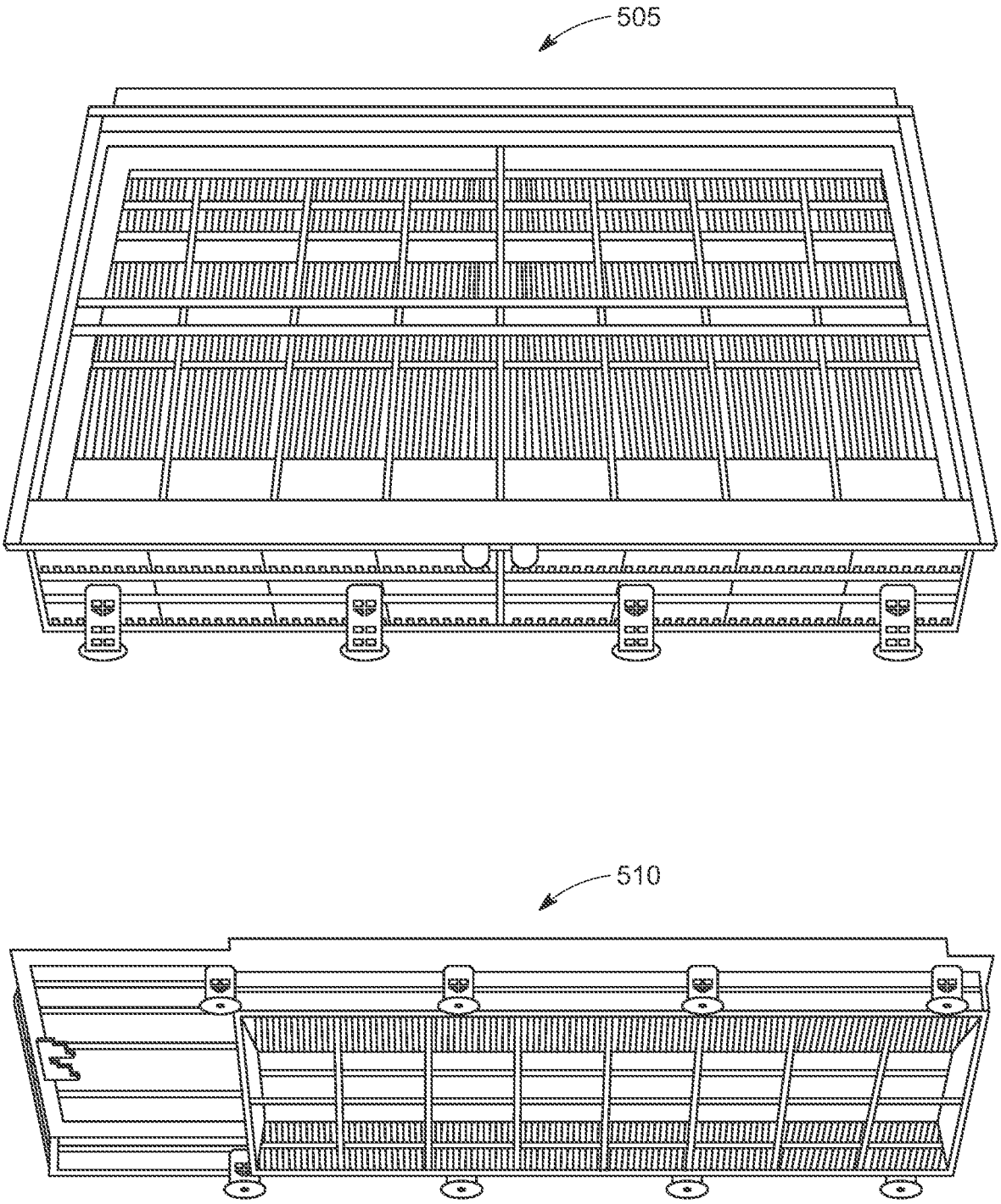
FIG. 5 illustrates a first battery assembly and a second battery assembly for a marine vessel according to some implementations.

FIG. 5 illustrates a first battery pack or assembly and a second battery pack or assembly for an electric-powered boat or marine vessel according to some implementations. In some implementations, first battery pack or assembly 505 and second battery pack or assembly 510 form or comprise a battery system. In some implementations, the first battery pack or assembly 505 and the second battery pack or assembly 510 may be combined to achieve a higher power output and a marine vessel kilowatt per hour capacity. In some implementations, first battery pack or assembly 505 may comprise one or more modules and/or second battery pack or assembly 510 may comprise one or more battery modules. In some implementations, one or more battery modules of first battery assembly 505 and second battery assembly 510 may comprise a number of battery cells. In some implementations, a power output (e.g., kilowatt per hour capacity) of first battery pack or assembly 505 and/or second battery pack or assembly 510 may be increased by adding additional modules. In some implementations, a power output (e.g., kilowatt per hour capacity) of first battery pack or assembly 505 and/or second battery pack or assembly 510 may be increased by adding additional cells to modules. As an example, if electric-powered recreational boat or marine vessel has a 200 kilowatt per hour capacity, first battery assembly or pack 505 may have 24 battery modules and second battery assembly or pack 510 may have 8 battery modules. In order to increase kilowatt per hour capacity, battery modules may be added to first battery assembly or pack 505 and/or second battery assembly or pack 510. In some implementations, in order to decrease kilowatt per hour capacity, battery modules may be removed from the above-identified first battery assembly or pack 505 and/or second battery assembly or pack 510. In some implementations, an ability to increase or decrease memory modules and/or memory cells enables a boat manufacturer to consider factors such as weight, cost, displacement and/or available deck space available in determining an optimal design for an electric-powered boat or marine vessel. This provides electric-powered boats or marine vessel designers and/or manufacturers with flexibility in creating designs to meet consumers' needs.

In some implementations, first battery pack or assembly 505 may include packing features In some implementations, first battery pack or assembly 505 and/or second battery pack or assembly 510 may include interconnection features. In some implementations, first battery pack or assembly 505 and/or second battery pack or assembly 510 may include battery cell electrical isolation features. In some implementations, first battery pack or assembly 505 and/or second battery pack or assembly 510 may include mechanical robustness and/or ruggedness features. In some implementations, first battery pack or assembly 505 and/or second battery pack or assembly 510 may include thermal control features. In some implementations, first battery pack or assembly 505 and/or second battery pack or assembly 510 may include thermal runway anti-cascading features.

In some implementations, first battery pack or assembly 505 and second battery pack or assembly 510 may be mounted to a hull assembly via a shock absorbing assembly to dampen movement of first battery pack or assembly 505 and/or second battery pack or assembly 510 along a x dimension, a y dimension, and/or a z dimension.

In some implementations, first battery pack assembly 505 and/or second battery pack or assembly 510 may be built and/or manufactured separately from the boat or marine vessel (and thus the hull assembly). In some implementations, first battery pack or assembly 505 and/or second battery pack or assembly 510 may thus be sold to different potential manufacturers of electric-powered boats or marine vessels. In some implementations, during final assembly of an electric-powered boat or marine vessel, first battery pack or assembly 505 and/or second battery pack or assembly 510 may be inserted into an electric-powered boat or marine vessel before a deck assembly or surface is placed into the marine vessel. In some implementations, first battery pack or assembly 505 and/or second battery pack or assembly 510 may be removed from the electric-powered boat or marine vessel (and thus the hull assembly) for maintenance, repair and/or replacement, without cutting a hull assembly. In some implementations, first battery pack or assembly 505 and/or second battery pack or assembly 510 may (along with an electric-powered motor assembly) be assembled or inserted into a hull assembly of an existing boat or marine vessel to create an electric-powered marine vessel (after a gasoline-powered motor system has been removed). In some implementations, first battery pack or assembly 505 and/or second battery pack or assembly 510 along with an electric-powered motor system may be connected to an existing propulsion system to propel marine vessel in the water.

Figure 6:
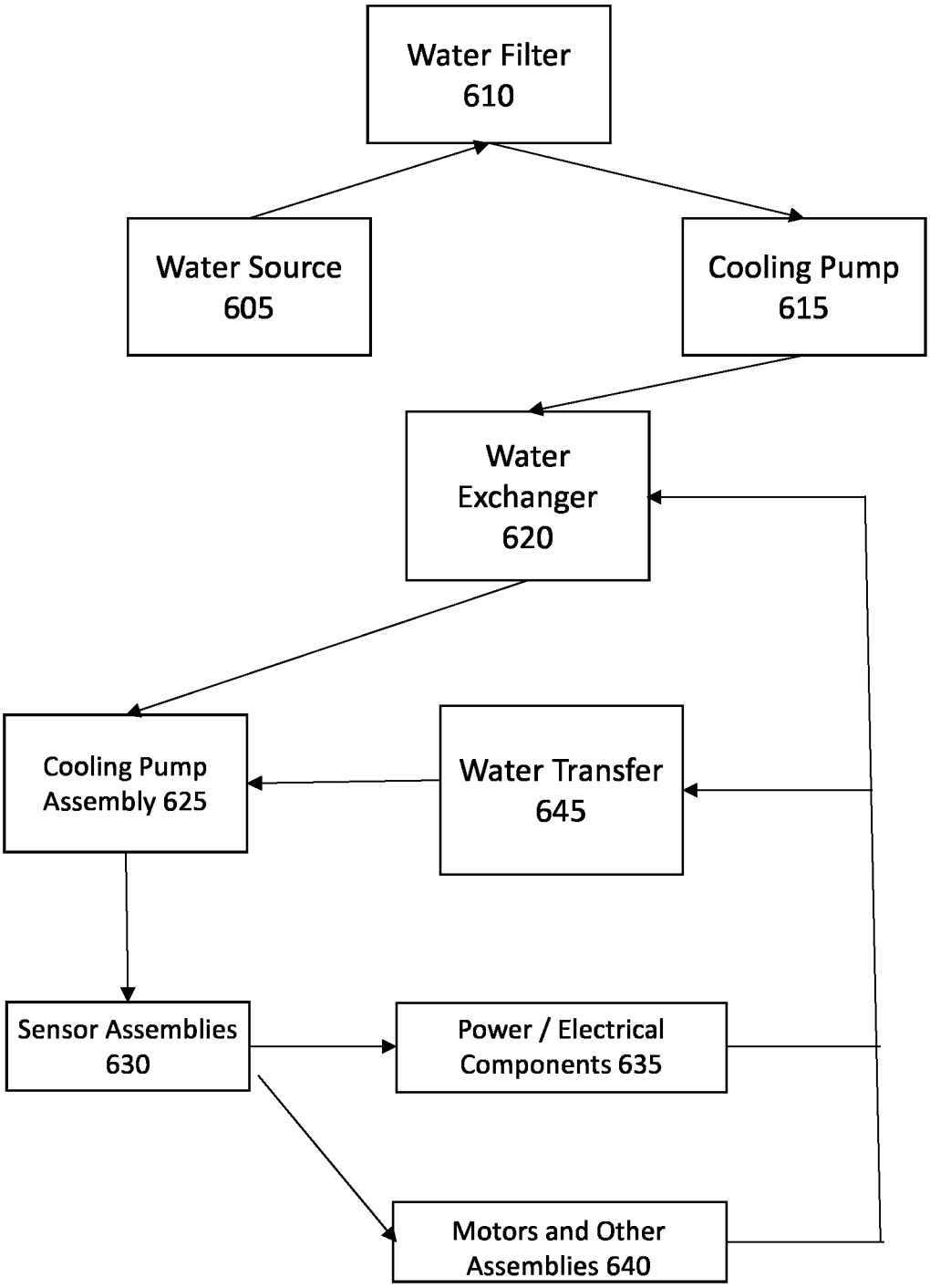
FIG. 6 illustrates a block diagram schematic of a water cooling system according to some implementations.

FIG. 6 illustrates a block diagram schematic of a water cooling system according to some implementations. In some implementations, an external water source 605 may supply water to the electric-powered marine vessel or boat. In some implementations, the external water source 605 may be a lake, a pond, and/or an ocean. In some implementations, water provided by the external water source 605 may be filtered by a water filter assembly 610. In some implementations, a cooling pump assembly 615 may cool the filtered water and may provide the cooled water to the water exchanger assembly 620. In some implementations, the cooled water or coolant may be provided to a cooling pump assembly 625 in order to be supplied to cool other components in the electric-powered marine vessel or boat. In some implementations, one or more sensor assemblies 630 may monitor a flow, a temperature and/or a pressure of the cooled water or coolant. In some implementations, the cooled water or coolant from the cooling pump assembly 625 may dissipate heat generated by the power and/or electrical components 635 and/or motors and/or other assemblies 640. In some implementations, the coolant or cooled water may then be supplied to a water tank or reservoir assembly 645 for later use. In some implementations, the water tank assembly 645 may supply coolant or cooled water to the cooling pump assembly 625.

In some implementations, an electric-powered boat or marine vessel may be assembled without cutting into and/or damaging the hull assembly. In some implementations, a company may construct a hull assembly of an electric-powered boat or marine vessel. In some implementations, an electric-powered motor assembly may be inserted into hull assembly. In some implementations, one or more ballast assemblies may be inserted into hull assembly. In some implementations, a first battery pack or assembly may be inserted into a hull stern. In some implementations, a second battery pack or assembly may be inserted a hull midship. In some implementations, a desk assembly may be placed onto hull assembly. In some implementations, electric-powered motor assembly, one or more ballast assemblies, first battery pack or assembly and second battery pack or assembly may be disposed under the deck assembly. In some implementations, deck assembly may be removed in order to perform maintenance on first battery pack or assembly or second battery pack or assembly without cutting hull assembly. In some implementations, deck assembly may be removed in order to remove first battery pack or assembly or second battery pack or assembly without cutting hull assembly.

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or aspects described are capable of being combined in various ways in one or more implementations and, therefore, are within intended claim scope, for example. In general, of course, these and other issues vary with context. Therefore, particular context of description and/or usage provides helpful guidance regarding inferences to be drawn.

In the drawings and/or description, as was indicated, like parts and/or features are typically marked throughout the specification and/or drawings with the same reference numerals, respectively, if applicable. Again, the drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

While there has been illustrated and described what are presently considered to be example features and/or aspects, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter may also include all aspects falling within the scope of the appended claims, and equivalents thereof.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics. Likewise, the term "based on" and/or similar terms are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more examples; however, again, particular context of description and/or usage provides helpful guidance regarding inferences to be drawn.

What is claimed is:

1. A marine vessel, comprising:

a hull assembly, the hull assembly comprising:

a deck assembly, the deck assembly contained within the hull assembly;

a first battery assembly disposed under the deck assembly, the first battery located in a stern region of the marine vessel equidistance from a starboard side and a port side of the marine vessel to increase stability and facilitate wake generation;

a second battery assembly disposed under the deck assembly and physically separate from the first battery assembly, the second battery assembly positioned within a midship region of the hull assembly, the second battery being elongated and extending from the stern region to a bow region of the marine vessel to increase stability and facilitate wake generation; and an electric motor assembly to receive electric power from the first battery assembly and the second battery assembly to propel the hull assembly through water during operation.

2. The marine vessel of claim 1, wherein the second battery assembly is positioned equidistant from the starboard side and the port side of the marine vessel.

3. The marine vessel of claim 1, wherein the first battery assembly and the second battery assembly are removable without disassembly of the hull assembly.

4. The marine vessel of claim 1, wherein the first battery assembly and the second battery assembly are removable from a top surface of the hull assembly.

5. The marine vessel of claim 1, wherein the first battery assembly has a dimension extending from the starboard side to the port side of less than 1650 millimeters, a dimension extending from the stern region to the bow region of less than 1072 millimeters and a depth of less than 270 millimeters, and generates a minimum of 150 kilowatt hours of power.

6. The marine vessel of claim 1, wherein the second battery assembly has a dimension extending from the stern region to the bow region of less than 2532 millimeters, a dimension extending from the starboard side to the port side of less than 555 millimeters and a depth of less than 160 millimeters, and generates a minimum of 50 kilowatt hours of power.

7. The marine vessel of claim 1, wherein the first battery assembly and the second battery assembly are positioned equal or at a higher height than ballast assemblies.

8. The marine vessel of claim 1, wherein the first battery assembly and the second battery assembly are disposed in or above a bilge area of the marine vessel.

9. The marine vessel of claim 1, wherein the first battery assembly and the second battery assembly supply power greater than 7.5 kilowatt hours per hull or marine vessel foot.

10. The marine vessel of claim 1, wherein the first battery assembly and the second battery assembly supply power greater than 165 Watt hours per kilogram.

11. The marine vessel of claim 1, wherein the first battery assembly and the second battery assembly are encapsulated, water resistant, or waterproofed.

12. The marine vessel of claim 1, wherein the first battery assembly and the second battery assembly are mounted to the hull assembly via shock absorbing assemblies to dampen x, y and/or z-direction movements.

13. The marine vessel of claim 1, wherein the first battery assembly is disposed behind passenger seating, below a deck surface and below a storage compartment.

14. The marine vessel of claim 1, wherein a location and size of the first battery assembly distributes weight in the stern region from the port side and the starboard side.

15. The marine vessel of claim 1, wherein the second battery assembly is disposed in the midship region of the hull assembly, in a middle of passenger seating and below a deck level.

16. The marine vessel of claim 1, wherein a location of the second battery assembly distributes weight from the midship region of the hull assembly toward both the stern region and the bow region.

17. A method of assembling an electric powered recreation boat or marine vessel, comprising:

inserting an electric-powered motor assembly into a hull assembly;

inserting one or more ballast assemblies into the hull assembly;

inserting a first battery assembly into a stern region equidistant from a starboard side and a port side of the electric-powered recreation boat or marine vessel to increase stability and facilitate wake generation;

inserting a second battery assembly into a midship region, the second battery being elongated and extending from the stern region to a bow region of the electric-powered recreation boat or marine vessel to increase stability and facilitate wake generation;

placing a deck assembly onto the hull assembly such that the electric-powered motor assembly, the one or more ballast assemblies, the first battery assembly and the second battery assembly are disposed under the deck assembly.

18. The method of claim 17, further comprising:

removing the deck assembly to maintain or remove the first battery assembly or the second battery assembly without cutting the hull assembly.

19. The marine vessel of claim 1, wherein;

the first battery assembly is configured to generate a power in a range of about 140 kilowatt hours to about 450 kilowatt hours; and the second battery assembly is configured to generate a power in a range of about 40 kilowatt hours to about 150 kilowatt hours.

* * * * *